United States Patent [19]

Ljutic

[11] 4,447,975

[45] May 15, 1984

[54] GUN WITH REDUCED RECOIL

[76] Inventor: Albert V. Ljutic, 602 N. 52nd Ave., Yakima, Wash. 98902

[21] Appl. No.: 244,979

[22] Filed: Mar. 18, 1981

[51] Int. Cl.[3] ..... F41C 11/00

[52] U.S. Cl. ..... 42/16; 42/1 Q; 42/1 S; 42/69 A; 42/76 R; 42/78; 42/DIG. 1

[58] Field of Search ..... 42/69 A, 16, 1 Q; 89/180, 42 B

[56] References Cited

U.S. PATENT DOCUMENTS 3,225,657 12/1965 Kruzell ..... 42/69 A
3,483,648 12/1969 Speckhart ..... 89/42 B
4,126,079 11/1978 Perrine ..... 42/69 A

*Primary Examiner*—Charles T. Jordan
*Assistant Examiner*—Ted L. Parr
*Attorney, Agent, or Firm*—Seed and Berry

[57] ABSTRACT

A gun with a spring-urged thrust hammer which first strikes the firing pin when released by the trigger and then has its forward thrust transferred from the firing pin to the bolt so that the hammer, firing pin and bolt are moving forward the extent of the headspace tolerance to counter recoil as the gun fires. This arrangement is shown applied to a shotgun having a unique barrel and sight.

13 Claims, 14 Drawing Figures

FIG. 2
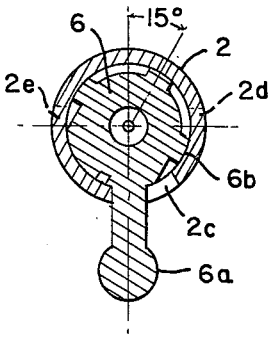
FIG. 3
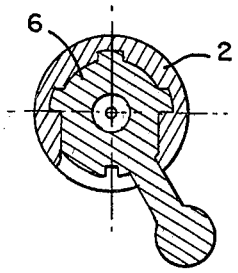
FIG. 4
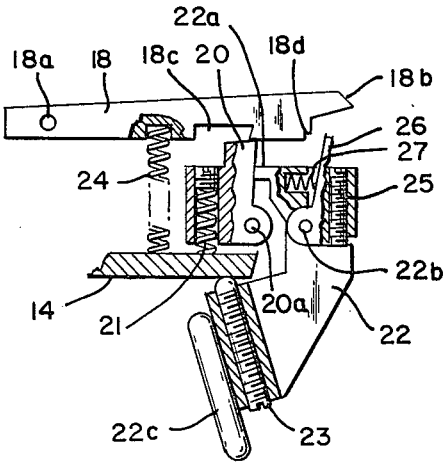
FIG. 5
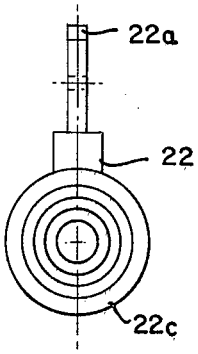
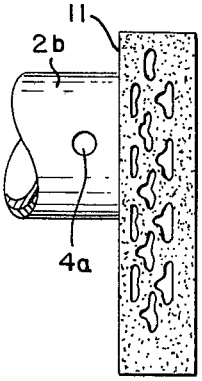
FIG. 6

FIG. 9
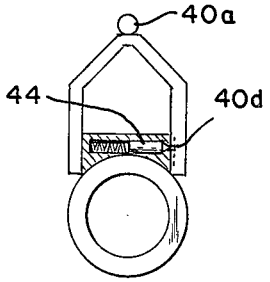
FIG. 10
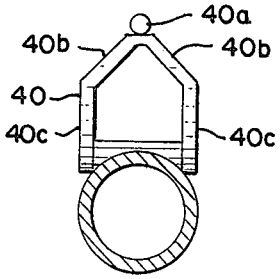
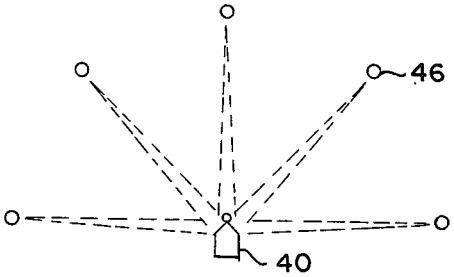
FIG. 11
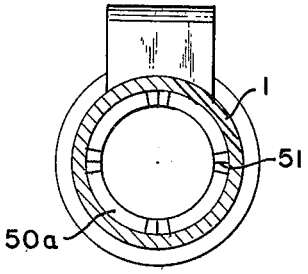
FIG. 13
FIG. 12
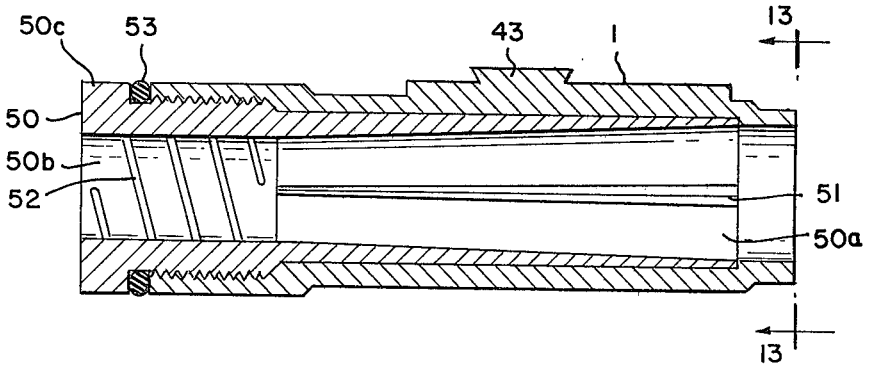

GUN WITH REDUCED RECOIL

DESCRIPTION

1. Technical Field

The present invention relates to guns, and more particularly, to systems for reducing recoil and increasing range and accuracy.

2. Background Art

In an effort to reduce the effect of recoil, it has been common to attempt to reduce the weight of the firing pin and other moving parts in the receiver behind the barrel on the theory that the recoil effect will be reduced because the rearward momentum of these lighter parts will be reduced upon firing the cartridge. The common arrangement has been to lock the bolt in firing position with a predetermined headspace behind the barrel; i.e., the bolt cannot engage the barrel even when a cartridge is in the chamber. During the firing sequence, the hammer hits a light firing pin, and, as the firing pin hits the shell, the hammer is stopped by directly contacting the receiver or the locked bolt. When the cartridge fires, the base of the shell recoils against the bolt, and this shock then passes through the receiver and butt stock to the marksman. There is always a tolerance to the headspace, and hence there is a resulting rearward thrust movement on the base of the cartridge when it fires. In other words, the spent cartridge always has rearward horizontal momentum independent of the gun before the spent cartridge is thrust firmly against the forward end of the bolt. This movement affects the recoil and varies from cartridge to cartridge. It also affects the forward charge of the shot or bullet, and hence affects the trajectory and range. Even the most skilled marksman cannot fully compensate for these variances and the recoil.

DISCLOSURE OF THE INVENTION

The present invention departs from the lightweight approach for moving parts and introduces a spring-loaded thrust hammer which not only drives the firing pin into the cartridge but also drives the bolt forwardly via the firing pin so that when the cartridge fires, the thrust hammer, firing pin and bolt are all moving forward to counteract the recoil. The bolt is thrust fowardly against the cartridge and takes up the headspace tolerance as the cartridge fires. As a result, the recoil affect on the marksman is substantially eliminated, and range and accuracy are increased.

The invention also includes improvements in barrel construction and sights for shotguns to increase the range and improve the pellet pattern on the target.

BRIEF DESCRIPTION OF THE DRAWINGS

FIGS. 2 and 3 are transverse sectional views through the bolt lugs and handle showing the bolt in locked and unlocked positions, respectively.

FIG. 4 is an elevational detail view with parts broken away, showing the trigger and sear assembly in cocked position;

FIG. 5 is a front elevation of the trigger element;

FIG. 6 is a fragmentary elevational view, partly in longitudinal section, showing the butt pad compressed to an exaggerated degree for purposes of illustration;

FIG. 9 is a front view of the sight;

FIG. 10 is a sectional view taken along line 10—10 of FIG. 8;

FIG. 11 is a diagram illustrating use of the sight;

FIG. 12 is a longitudinal cross-section of part of the forward end of the barrel, with the sight removed; and FIG. 13 is a transverse sectional view taken as indicated by line 13—13 of FIG. 12.

BEST MODE FOR CARRYING OUT THE INVENTION

Figure 1:
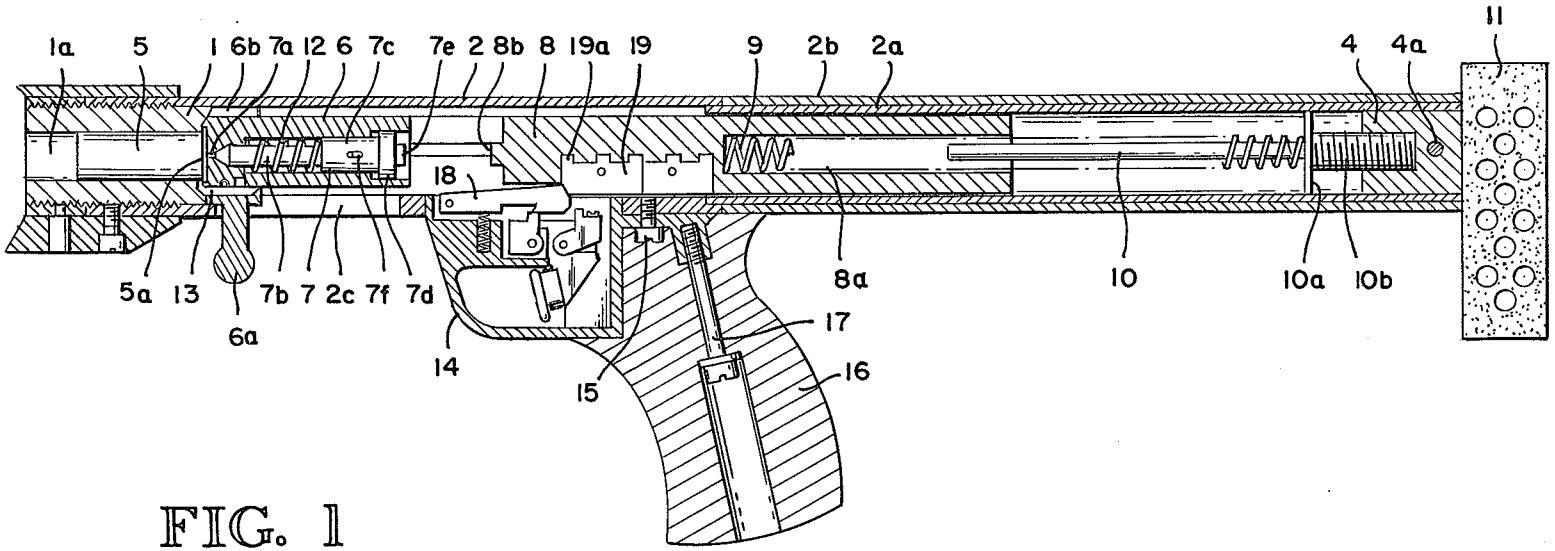
FIG. 1 is a fragmentary longitudinal sectional view of a shotgun embodying the present invention showing the bolt and firing pin in fired position and the trigger and thrust hammer in cocked position.
Figure 1A:
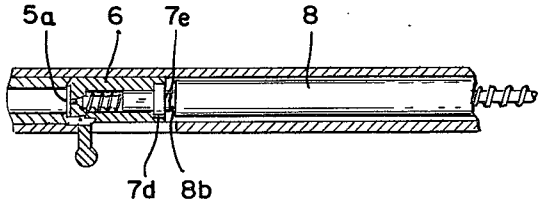
FIG. 1A is a fragmentary longitudinal sectional view, showing the gun of FIG. 1 with the bolt, firing pin, and thrust hammer in fired position.

Referring to the drawings, barrel 1 is male threaded at the rear to screw attach to a female threaded portion at the front of a receiver 2. Forwardly of the receiver 2, and also screwed onto the barrel 1, is a headspace adjustment collar 3 locked in adjusted position to the barrel by a radial set screw 3*a*. The receiver 2 has a tubular rearward extension 2*a* secured therein onto which is sleeved a butt stock 2*b*. Fitted in the rear of the receiver extension 2*a* is a stop plug 4. This plug, the receiver extension 2*a*, and the butt stock 2*b* are connected together by a cross-pin 4*a*.

The barrel 1 is chambered conventionally at 1*a* to receive a shotshell or cartridge 5 having its head flange 5*a* occupying the headspace between the rear end of the barrel and the forward end of a bolt 6 having a handle 6*a*. Slide-mounted in the bolt 6 is a firing pin unit 7 which projects rearwardly to be engaged by a thrust hammer 8. This hammer is urged forwardly by a compression spring 9 which extends into a rear axial bore 8*a* in the hammer and seats at the rear on a washer 10*a* at the root end of a guide rod 10. This rod 10 has an enlarged rear screw portion 10*b* threaded into the plug 4 to adjust the force exerted by the spring 9 on the thrust hammer 8. A compressible butt pad 11 is mounted directly on the back of the plug 4 or on a faceplate in turn mounted on the plug 4.

Progressing from front to back, the firing pin unit 7 has a firing pin 7*a*, a spring guide portion 7*b* for a return compression spring 12, an enlarged slide portion 7*c*, a stop collar 7*d*, and an impact head 7*e*. Axial return travel of the firing pin to the rear relative to the bolt 6 is limited by a cross-pin in the bolt passing through a longitudinal slot 7*f* in the slide portion 7*c* of the firing pin unit. The bolt has a longitudinal bore stepped to first match the firing pin 7*a* at the front, then the guide portion 7*b* for a short part of the length thereof, then the enlarged slide portion 7*c*, and finally the stop collar 7*d* at the rear. It will also be noted that the forward end of the bolt 6 is dished to receive the cartridge flange 5*a*. This dishing is slightly shallower than the fully compressed thickness of the cartridge flange after firing of the cartridge. When the return spring 12 has retracted the firing pin unit, the nose of the firing pin 7*a* is totally withdrawn from the dished portion at the front of the bolt. In FIG. 1, the firing pin unit 7 and bolt 6 are shown in the position they occupy when the cartridge 5 has been fired, whereas, for illustrative purposes, the thrust hammer 8 is shown retracted.

The receiver 2 has a bottom opening 2c for the passage of a cartridge 5 and circumferentially spaced, longitudinal guide grooves 2d for receiving radially projecting locking lugs 6b on the forward end portion of the bolt 6. These guide grooves 2d have circumferential extensions 2e of about 15° at their forward end for receiving the bolt lugs 6b when the bolt is in loaded position and turned counterclockwise, as viewed in FIGS. 1–3. It is important to understand that when the bolt lugs 6b are in the circumferential extensions 2e of the receiver grooves 2d, there is enough axial play of the bolt relative to the receiver that the bolt can engage the rear end of the barrel if pushed forwardly when in loaded position without a cartridge in the chamber. This play is also sufficient to accommodate various thicknesses of cartridge flanges and is known as the "headspace tolerance." A cartridge ejector 13 is mounted on the underside of the bolt to grip behind the cartridge lip 5a and thereby pull the cartridge out of the barrel chamber 1a when the bolt 6 is retracted after firing.

A trigger housing 14 is connected by screw 15 to the underside of the receiver 2 and has a handle 16 in turn mounted thereon by bolt 17. As best seen in FIG. 4, swing-mounted by pin 18a at the top of the trigger housing 14 is a primary sear 18 which is urged upwardly by a compression spring 24 so that its beveled nose 18b engages the nose of an adjustable sear plate 19 mounted in a recess at the bottom of the hammer 8. This recess has a series of transverse grooves matched by tongues 19a in the sear plate so that the sear plate position can be adjusted longitudinally relative to the thrust hammer 8.

A secondary sear 20 is pivotally mounted at 20a to the trigger housing and is urged upwardly by adjustable spring 21 to catch beneath the primary sear to thereby hold the position until dislodged into a cutout 18c by the nose 22a of the trigger 22, which pivots at pin 22b. The trigger 22 has an adjusting screw 23 for adjusting sensitivity and preferably has a button head 22c.

When the bolt 6 is pulled back preparatory to loading of a cartridge 5, the thrust hammer 8 is pushed back against the pressure of the spring 9 until the sear plate 19 has cleared the primary sear 18, whereupon the spring 24 forces the nose 18b into engagement with the beveled forward end portion of the sear plate 19 to hold the thrust hammer in cocked position. As previously indicated, the secondary sear 20 in turn holds the primary sear 18 cocked until the trigger 22 is pulled. After the cartridge is then manually inserted from underneath, the bolt is pulled forward and locked. The gun is then ready to be fired.

When the trigger 22 is then pressed, the thrust hammer 8 accelerates forwardly by action of the spring 9 and the nose 8b of the hammer strikes the head 7e of the firing pin unit 7 and overcomes the return spring 12, whereupon the firing pin 7a strikes the cartridge primer to fire the cartridge. At substantially the same instant, the front annular shoulder of the enlarged stop collar 7d impacts on the opposing face of the bolt. As a result, the bolt 6 accelerates forwardly with hammer 8 through the narrow expanse of the headspace tolerance and slams against the cartridge as it fires. Hence, when the cartridge explodes, recoil is resisted by the combined forward thrust forces exerted by the forwardly accelerating masses of the thrust hammer, bolt and firing pin unit. These three parts are purposely made heavy enough, as, for example, 1.65#, 0.7#, and 0.5#, respectively, that the recoil thrust is substantially countered. If any is left, the marksman is relieved of it by compression of the butt pad 11, which is made of a suitable cellular elastomeric material. Because the firing pin is driven forwardly with considerable force by the hammer 8 when the gun is being fired, the nose of the firing pin can be blunt, thereby reducing the chance that the primer anvil will be cocked by the impact of the firing pin.

When it is desired to convert to a release-type trigger, an adjusting screw 25 on a release sear 26 is tuned clockwise in opposition to spring 27 until the release sear pivots at 22b relative to the trigger in the counterclockwise direction, as viewed in FIG. 4, to a travel limit. Then, when the gun is to be fired, first the trigger is pressed until it stops. This causes the tip of the release sear 26 to engage the portion 18d of the primary sear 18 at the same time as the secondary sear 20 releases. The primary sear 18 will then be kept in hammer-retaining position by the release sear 26 until the trigger is released. This reduces flinching and gives a more relaxed firing condition.

Figure 7:
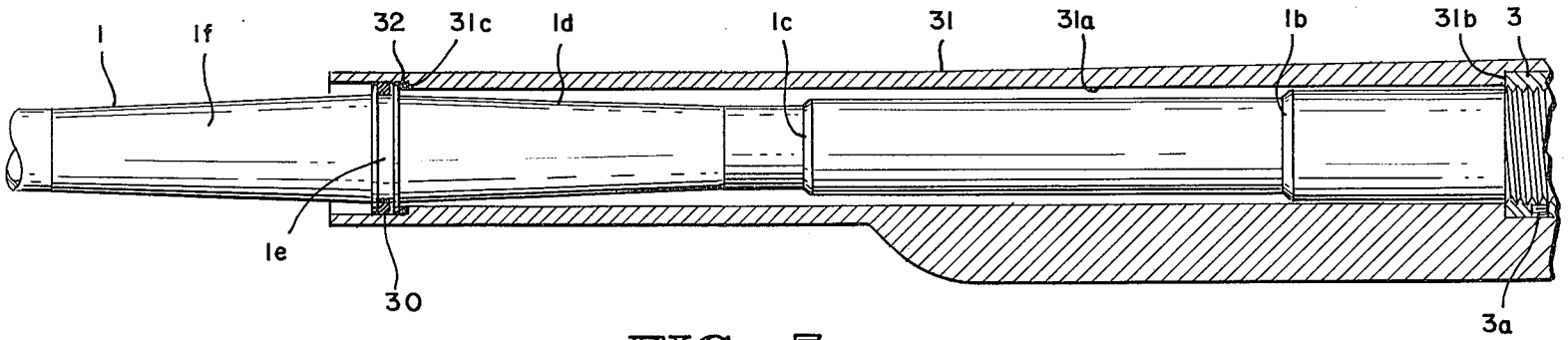
FIG. 7 is a longitudinal elevational view, with the headstock in section, of a midportion of the barrel located forwardly of the portion shown in FIG. 1.
Figure 8:
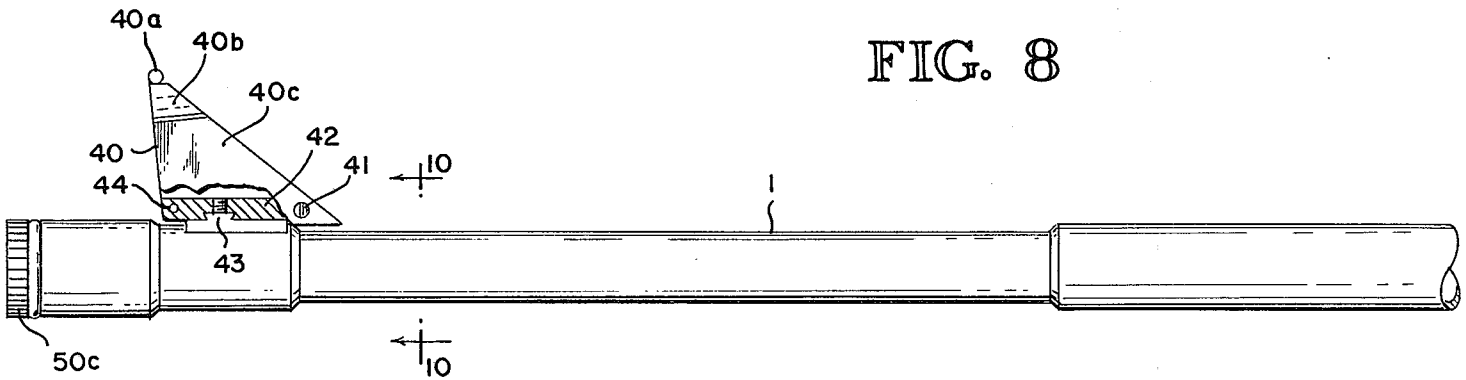
FIG. 8 is a longitudinal elevational view of the front portion of the barrel located forwardly of the portion shown in FIG. 7, with part of the sight mechanism broken away.

Directing attention to FIG. 7, the barrel 1 is designed to overcome vibration overtones and undertones without added weight. For this purpose, the barrel is twice stepped at 1b and 1c instead of being conventionally tapered and then tapers outwardly along portion 1d to a circumferentially grooved integral collar 1e receiving an elastic O-ring 30. From the collar 1e, the barrel tapers inwardly again along portion 1f. The forestock 31 has a bore 31a with a diameter larger than any portion of the barrel therein except for the collar 30. This bore 31a is counterbored at the ends to provide a rear shoulder 31b to engage the front face of the adjustment collar 3 and a front shoulder 31c opposing the rear face of the collar 1e. An elastic O-ring 32 is placed between shoulder 31c and the collar 30 to provide tolerance for adjustment of the collar 3 while keeping the forestock 31 in firm position. This is assisted by the O-ring 30 which fits snugly in the forward end of the bore 31a and keeps the collar 1e out of direct radial contact with the headstock.

Continuing to FIGS. 8–11, there is shown an improved sighting device 40 for shotgun use. This sight has a top ball 40a visually emphasizing the peak of a pair of diverging triangular side walls 40b which join vertical trapezoidal side walls 40c. The latter are swing-mounted at the rear on screw pins 41 extending into a base which has a bottom transverse dovetail slot to fit over a dovetail tenon 43 on the barrel. The swing-mounting of the sight varies the height of the ball 40a over the barrel for different users and the adjusted positions are maintained by a ratchet click 44 meshing with a row of teeth 40d on the inside face of a respective one of the side walls 40c. As indicated in FIG. 10, the back edges of the sight walls 40b, 40c and the base are preferably treated by striping or otherwise to minimize light reflection.

FIG. 11 shows by broken lines how an isosceles triangle is formed by the user's eyes with reference to the sight and the target 46 in skeet shooting with a shotgun equipped with the sight mechanism. The triangle design of the sight sustains the visual image and assists in achieving eye and hand coordination in teaching and leading the target and determining when to fire. The design of the sight helps the user to keep his eyes properly fixed on the moving target and to achieve accurate depth perception and speed judgment for firing accuracy.

Continuing to FIGS. 12–13, the barrel 1 has its forward end portion adapted to receive a screw-in type of choking device 50 which has a rear choking bore section 50*a*, a front straight bore section 50*b*, and a head grip flange 50*c*. An elastic O-ring 53 is seated between the flange 50*c* and the front of the barrel 1. The choking section 50*a* has four sets of line grooves 51 as rifling, one in each guadrant, extending lengthwise of the barrel. Each rifling set may have three grooves. The purpose of these grooves is to cause the shot pellets to leave the barrel equally dispersed. The straight portion 50*b* preferably has a helical groove pattern 52 to reduce shot drag. It has been found that use of the described choking device 50 helps to achieve a greater range and gives superior pattern performance.

I claim:

1. A gun comprising, a barrel with a rear cartridge receiving chamber, a rearwardly extending receiver unit connected to the barrel, a bolt mounted in the receiver unit for movement between a forward locking position adjoining said chamber and a rearward retracted position, said receiver unit being adapted to receive a flanged cartridge through a loading zone for loading into said chamber when the bolt is in retracted position, said bolt being lockable when in said forward locking position to hold said cartridge in said chamber, said bolt having a defined longitudinal movement when locked in said forward locking position to provide a headspace zone sufficient to accommodate various thicknesses of cartridge flanges, firing pin means slidably mounted in said bolt for movement between a firing position in which it projects forwardly beyond the bolt and a retracted position, said firing pin means engaging a rearwardly facing portion of said bolt when in firing position, hammer means slidably mounted in the receiver unit for longitudinal movement therein between a forward engagement position engaging said firing pin means and a retracted position clear of said loading zone, said hammer means being arranged to engage the rear end of the firing pin means and drive said firing pin means into engagement with said rearwardly facing portion of said bolt when in said forward engagement position and to retract responsive to retraction of the bolt, spring means yieldingly resisting retraction of the hammer means, and trigger means for holding the hammer means in retracted position and for selectively releasing the hammer means to engage and drive the firing pin means forwardly into said firing position and to responsively drive the bolt forwardly through said headspace zone unoccupied by the cartridge flange and into engagement with the cartridge flange, the combined forward movement of said hammer means, firing pin means and bolt providing a forward thrust force countering recoil thrust upon firing of a cartridge in said chamber by the firing pin means.

2. A gun according to claim 1 in which said bolt and firing pin means comprises a bolt having a center bore therethrough and a firing pin slidably mounted in said bore for restricted endwise movement relative to the bolt.

3. A gun according to claim 2 in which said firing pin projects forwardly beyond the bolt when in firing position and rearwardly beyond the bolt when in retracted position.

4. A gun according to claim 2 in which said bolt has a rearwardly facing impact face and said firing pin has an impact face opposing said rearwardly facing impact face and spaced rearwardly therefrom when the bolt and firing pin assembly are in retracted position, said firing pin being arranged to be struck by said hammer means and to responsively have its impact face strike the impact face of the bolt and drive said bolt into said headspace zone.

5. A gun comprising, a barrel with a rear cartridge receiving chamber, a rearwardly extending receiver unit connected to the barrel, a bolt mounted in the receiver unit for movement between a forward headspace zone adjoining said chamber and a rearward retracted position, said receiver unit being adapted to receive a cartridge through a loading zone for loading into said chamber when the bolt is in retracted position, firing pin means slidably mounted in said bolt for movement between a firing position in which it projects forwardly beyond the bolt and a retracted position, said firing pin means engaging a rearwardly facing portion of said bolt when in firing position, hammer means slidably mounted in the receiver unit for longitudinal movement therein between a forward position engaging said firing pin means and a retracted position clear of said loading zone, said hammer means being arranged to be engaged by the rear end of the firing pin means and retracted responsive to retraction of the bolt, spring means yieldingly resisting retraction of the hammer means for driving said hammer means forward into engagement with said firing pin means, said spring means being adjustable to provide a preselected forward force on said hammer means compatible with the load of the cartridge being fired to substantially avoid rebounding of said hammer means, and trigger means for holding the hammer means in retracted position and for selectively releasing the hammer means to engage and drive the firing pin means forwardly into firing position and to responsively drive the bolt forwardly for countering recoil thrust upon firing of a cartridge in said chamber by the firing pin means.

6. A gun according to claim 5 in which said retracted position of said hammer means is adjustable to provide further preselection of the forward force said spring means applies on said hammer means.

7. A gun according to claim 6 in which said trigger means includes a trigger assembly and a sear means for holding said hammer means in said retracted position by releasably engaging said trigger, said spring means driving said hammer means forward toward said firing pin means upon said trigger assembly disengaging said sear means, said sear means being longitudinally adjustable to vary said retracted position and preselect the forward force said spring means applies to said hammer means.

8. A gun according to claim 7 in which said sear means is an adjustable sear member attached to said hammer means, said sear member being selectively and releasably positionable along the length of said hammer means.

9. A gun according to claim 5 in which said spring means includes a compression spring and an adjustment screw to adjust the force said spring exerts on said hammer means.

10. A gun comprising, a barrel with a rear cartridge receiving chamber, a rearwardly extending receiver unit connected to the barrel, a bolt mounted in the receiver unit for movement between a foward headspace zone adjoining said chamber and a rearward retracted position, said receiver unit being adapted to receive a cartridge through a loading zone for loading into said chamber when the bolt is in retracted position, firing pin means slidably mounted in said bolt for movement between a firing position in which it projects forwardly beyond the bolt and a retracted position, said firing pin means engaging a rearwardly facing portion of said bolt when in firing position, hammer means slidably mounted in the receiver unit for longitudinal movement therein between a forward position engaging said firing pin means and a retracted position clear of said loading zone, said hammer means being arranged to engage the rear end of the firing pin means and place said firing pin means in said firing position, and to retract responsive to retraction of the bolt, spring means yieldingly resisting retraction of the hammer means, and trigger means for holding the hammer means in retracted position and for selectively releasing the hammer means to engage and drive the firing pin means forwardly into firing position and through said firing pin means to drive said bolt forwardly to engage a cartridge in said chamber, said firing pin means firing said cartridge at substantially the same time said bolt engages said cartridge, said combined forward movement of said hammer means, firing pin means, and bolt providing a forward thrust force countering the recoil thrust of said cartridge.

11. A gun according to claim 10 in which said firing pin means includes a slidably mounted firing pin having a forwardly facing engagement shoulder positioned for engagement with said rearwardly facing portion of said bolt as said firing pin reaches said firing position under the forward drive of said hammer means, said hammer means thereafter driving said bolt forward into said headspace zone by engagement of said firing pin engagement shoulder with said rearwardly facing bolt portion.

12. A gun according to claim 10, further including means for adjusting the forward force applied to said hammer means by said spring means.

13. A gun according to claim 10, further including means for adjusting said retracted position of said hammer means.

* * * * *